US011125137B2

(12) United States Patent
Yamamoto et al.

(10) Patent No.: US 11,125,137 B2
(45) **Date of Patent: *Sep. 21, 2021**

(54) METHOD OF MANUFACTURING AN INSULATOR WITH SWAGED PERFORATED FLANGES

(71) Applicant: FUTABA INDUSTRIAL CO., LTD., Okazaki (JP)

(72) Inventors: Kouhei Yamamoto, Okazaki (JP); Fuyuki Itoh, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/253,744

(22) Filed: Jan. 22, 2019

(65) Prior Publication Data

US 2019/0234286 A1 Aug. 1, 2019

(30) Foreign Application Priority Data

Jan. 26, 2018 (JP) ..... JP2018-011692

(51) Int. Cl.
*F01N 13/10* (2010.01)
*F01N 13/18* (2010.01)
(Continued)

(52) U.S. Cl.
CPC ..... *F01N 13/102* (2013.01); *F01N 3/05* (2013.01); *F01N 13/14* (2013.01); *F01N 13/18* (2013.01);
(Continued)

(58) Field of Classification Search
CPC ..... F01N 13/102; F01N 13/14; F01N 13/18; F01N 3/05; F01N 2470/24;
(Continued)

(56) References Cited

U.S. PATENT DOCUMENTS 6,983,768 B1 * 1/2006 Vujic ..... F16L 59/141 138/119
7,041,359 B2 * 5/2006 Hijikata ..... B01D 39/2068 422/179
(Continued)

FOREIGN PATENT DOCUMENTS

JP 2000332452 A 11/2000
JP 2002285842 A 10/2002
(Continued)

OTHER PUBLICATIONS

English translation of the Notice of Reasons for Rejection from the Japanese Patent Office, dated Dec. 17, 2019 for corresponding Japanese Application No. 2018-011692.
(Continued)

*Primary Examiner* — Sarang Afzali
(74) *Attorney, Agent, or Firm* — David D. Brush; Westman, Champlin & Koehler, P.A.

(57) ABSTRACT

Provided is a method of manufacturing an insulator including disposing first and second covering members, and swaging the first covering member with the second covering member. The first and second covering members each include a groove and flanges including a perforated flange. The second covering member is disposed on the first covering member such that an inner side of the groove of the second covering member faces an inner side of the groove of the first covering member; the flanges of the second covering member are individually placed on the flanges of the first covering member; and a pin retained on a base is inserted through the perforated flange of the second covering member, to thereby fix the second covering member in position. In the swaging, at least the respective perforated flanges of the first and second covering members are swaged with each other with the pin being inserted therethrough.

4 Claims, 8 Drawing Sheets

(51) Int. Cl.
*F01N 13/14* (2010.01)
*F28F 1/14* (2006.01)
*F01N 3/05* (2006.01)

(52) U.S. Cl.
CPC ..... *F28F 1/14* (2013.01); *F01N 2260/022* (2013.01); *F01N 2470/24* (2013.01); *Y10T 29/49398* (2015.01); *Y10T 29/49858* (2015.01); *Y10T 29/49936* (2015.01)

(58) Field of Classification Search
CPC ..... F01N 2260/022; F01N 3/2853; F01N 13/1888; F01N 13/1872; F01N 13/1894; F01N 2450/20; F01N 2450/02; F01N 2450/00; F28F 1/14; Y10T 29/49398; Y10T 29/49858; Y10T 29/49936
See application file for complete search history.

(56) References Cited

U.S. PATENT DOCUMENTS 7,087,286 B2 * 8/2006 Hijikata ..... B01D 39/2068 422/177
7,273,649 B2 * 9/2007 Miwa ..... F01N 3/2828 428/116
7,823,285 B2 * 11/2010 Cai ..... F01N 13/1888 29/890
7,879,430 B2 * 2/2011 Ohno ..... C04B 28/24 428/116
10,899,292 B2 * 1/2021 Yamamoto ..... F01N 13/1888
2007/0116617 A1 * 5/2007 Lawrukovich ..... F01N 13/1888 422/179
2017/0284272 A1 * 10/2017 Wolf ..... F01N 13/14
2019/0161029 A1 * 5/2019 Yamamoto ..... F16L 59/024

FOREIGN PATENT DOCUMENTS

JP 2004360501 A 12/2004
JP 2006167754 A 6/2006

OTHER PUBLICATIONS

English translation of the Notice of Reasons for Refusal dated Apr. 28, 2020 for corresponding Japanese Application No. 2018/011692.
English translation of the Notice of Reasons for Refusal dated May 12, 2020 for corresponding Japanese Application No. 2018/011692.

* cited by examiner

METHOD OF MANUFACTURING AN INSULATOR WITH SWAGED PERFORATED FLANGES

CROSS-REFERENCE TO RELATED APPLICATIONS

This application claims the benefit of Japanese Patent Application No. 2018-011692 filed on Jan. 26, 2018 with the Japan Patent Office, the entire disclosure of which is incorporated herein by reference.

BACKGROUND

The present disclosure relates to a method of manufacturing an insulator and the insulator. The insulator is provided to an exhaust member that causes exhausted air from an internal combustion engine of a vehicle to flow downstream.

There has been known a tubular heat-insulation cover that covers an outer side of an exhaust system component of a vehicle. Patent Document 1 shown below discloses a method of mounting such a heat-insulation cover over an exhaust system component. According to the disclosed method, L-shaped brackets are welded onto an outer surface of the exhaust system component, which is a pipe. Then, the heat-insulation cover is swaged with the brackets to be mounted over the outer side of the exhaust system component.

PATENT DOCUMENT

Patent Document 1: Japanese Unexamined Patent Application Publication No. 2004-360501.

SUMMARY

However, such a mounting method of Patent Document 1 has a risk of causing deformation of the heat-insulation cover when the heat-insulation cover is swaged with the brackets. This occurs if the heat-insulation cover lacks stiffness, for example.

In one aspect of the present disclosure, it is desirable to favorably manufacture an insulator that is formed with a material having low-stiffness.

One aspect of the present disclosure is a method of manufacturing an insulator from a first covering member and a second covering member, both including a plate-shape. The method comprises disposing the first covering member, disposing the second covering member on the first covering member, and the first covering member with the second covering member. The insulator comprises a tubular shape to cover an exhaust member that causes exhausted air from an internal combustion engine of a vehicle to flow downstream. The first covering member and the second covering member each include a groove and flanges. The flanges include a perforated flange.

The groove includes a groove-like portion and separates an inner side of the insulator from an outer side of the insulator. The flanges protrude outward from a side rim of the groove. The perforated flange includes an insertion hole to allow insertion of a pin therethrough.

In the method of manufacturing the insulator, the first covering member is disposed such that: an outer side of the groove of the first covering member is supported by a first supporting member from below; each of the flanges of the first covering member is supported by a base from below; a pin, which is retained on the base, is inserted through the insertion hole of the perforated flange of the first covering member; and the first covering member is thereby fixed in position. Further, in the method of manufacturing the insulator, the second covering member is disposed on the first covering member such that: an inner side of the groove of the second covering member faces an inner side of the groove of the first covering member; the flanges of the second covering member are individually placed on the flanges of the first covering member; the pin, which is retained on the base, is inserted through the insertion hole of the perforated flange of the second covering member; and the second covering member is thereby fixed in position.

The method of manufacturing the insulator further comprises disposing a second supporting member to cover an outer side of the groove of the second covering member from above. Furthermore, in the method of manufacturing the insulator, at least the perforated flange of the first covering member including the insertion hole is swaged with the perforated flange of the second covering member including the insertion hole with the pin being inserted through the first and second covering members. Here, the perforated flange of the second covering member abuts the perforated flange of the first covering member.

Such a method enables the respective perforated flanges of the first and second covering members to be swaged with each other with the pin being inserted through the respective perforated flanges. It is therefore possible to inhibit the first and second covering members from being displaced in comparison with a configuration in which different flanges are arranged for different applications, such as for including an insertion hole to allow insertion of a pin therethrough and for including a portion to be swaged. It is therefore possible to favorably manufacture the insulator even if the first and second covering members are easily deformed.

In one aspect of the present disclosure, the swaging may be performed by compression pressing that decreases respective plate thicknesses of the perforated flange of the first covering member and the perforated flange of the second covering member.

Such a manufacturing method applies, as the swaging, the compression pressing to decrease the plate thickness and therefore, it is possible to both decrease a size of a swaging point formed by pressing and to firmly couple the respective perforated flanges of the first and second covering members together.

In one aspect of the present disclosure, the base includes a recessed portion including a recess bottom that is surrounded by a side surface of the recessed portion, the side surface having an upper end that abuts the first covering member. In the swaging, a punch portion may perform the compression pressing to press the perforated flange of the first covering member and the perforated flange of the second covering member into the recessed portion. The punch portion is smaller in circumference than the recessed portion is.

According to this manufacturing method, the punch portion performs the compression pressing as the swaging to press the respective perforated flanges of the first and second covering members into the recessed portion. This enables the respective perforated flanges of the first and second covering member to penetrate into each other by the pressing. As a result, it is possible to firmly couple the perforated flange of the first covering member to the perforated flange of the second covering member.

In one aspect of the present disclosure, the exhaust member may be disposed on the first covering member such that: the first covering member is disposed on the base; an exhaust flange is then brought into placement on the flanges of the first covering member before disposal of the second covering member on the first covering member, the exhaust flange protruding outward from an outer circumference of the exhaust member and including an insertion hole to allow insertion of the pin therethrough; the pin retained on the base is inserted through the insertion hole of the exhaust flange; and the exhaust member is thereby fixed in position.

Such a manufacturing method applies the swaging with the pin being inserted through the insertion hole that is included in the exhaust flange. As a result, it is possible to simultaneously fix the exhaust member with respect to the first covering member and to the second covering member when they are fixed to each other.

One aspect of the present disclosure may be an insulator formed into a tubular-shape to cover an exhaust member that causes exhausted air from an internal combustion engine of a vehicle to flow downstream. The insulator comprises a first covering member and second covering member, each including a plate-shape. The first covering member and the second covering member are assembled to each other, to thereby form the insulator. The first covering member and the second covering member each may include a groove and flanges.

The groove includes a groove-like portion separates an inner side of the insulator from an outer side of the insulator. The flanges protrude outward from a side rim of the groove. The flanges may include a perforated flange that includes an insertion hole to allow insertion of a pin therethrough.

The insulator may be assembled such that the insertion hole of the perforated flange of the first covering member communicates with the insertion hole of the perforated flange of the second covering member. Further, the perforated flange of the first covering member including the insertion hole and the perforated flange of the second covering member including the insertion hole each may include a swaged portion in which the perforated flange of the first covering member and the perforated flange of the second covering member penetrate into each other by pressing.

According to this configuration, the perforated flange of the first covering member is swaged with the perforated flange of the second covering member with the pin being inserted therethrough, to thereby form the swaged portion in which the respective perforated flanges of the first and second covering members penetrate into each other by pressing. In this configuration, the pin is located proximally to a portion to be swaged. Therefore, it is possible to favorably manufacture the insulator even if the first and second covering members are easily deformed. Further, in the swaged portion, the respective perforated flanges of the first and second covering members penetrate into each other by the pressing and thus, it is possible to firmly fix the respective perforated flanges of the first and second covering members to each other.

BRIEF DESCRIPTION OF THE DRAWINGS

An embodiment of the present disclosure will be described hereinafter by way of example with reference to the accompanying drawings, in which.

DETAILED DESCRIPTION OF THE EMBODIMENTS

The embodiment of the present disclosure is not limited to the following embodiments, and may be variously modified within the technical scope of the present disclosure.

[1-1. Configuration of Insulator]

Figure 1:
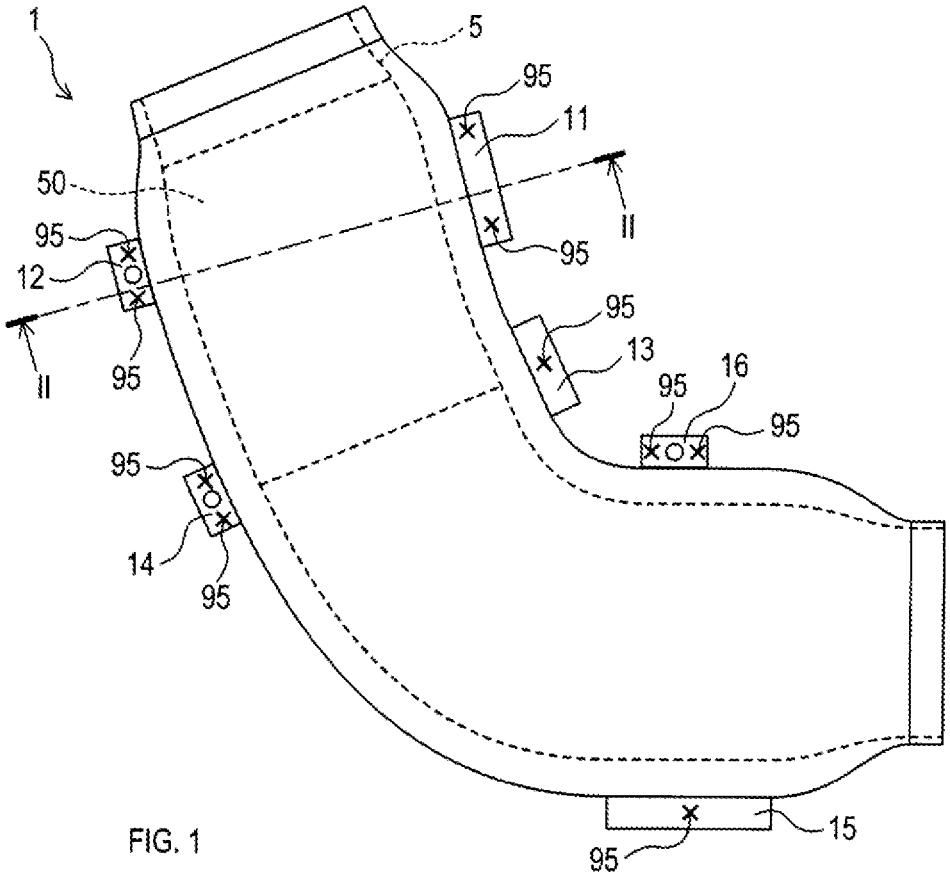
FIG. 1 is a schematic side view of an insulator.

As shown in FIG. 1, an insulator 1 is a tubular member that is mounted onto a vehicle, and is made of, for example, stainless-steel, aluminum, or the like. The insulator 1 is placed so as to cover an exhaust member 5. In other words, the exhaust member 5 is situated inside of the insulator 1. The exhaust member 5 causes exhausted air from an engine of the vehicle to flow downstream. The insulator 1 reduces at least some of noise, vibration, and heat dissipation from the exhaust member 5.

In one example, the exhaust member 5 may cause the exhausted air to flow downstream toward a turbine that drives a turbocharger disposed in the engine. The exhaust member 5 comprises a converter 50 that includes a catalyst 51 to purify the exhausted air (see, also FIG. 2). The insulator 1 may be used for an exhaust member that causes the exhausted air to flow downstream in another part of the vehicle.

The insulator 1 covers at least a portion of an outer side of the convertor 50 included in the exhaust member 5, in other words, at least a portion of an outer side of the catalyst 51.

Figure 2:
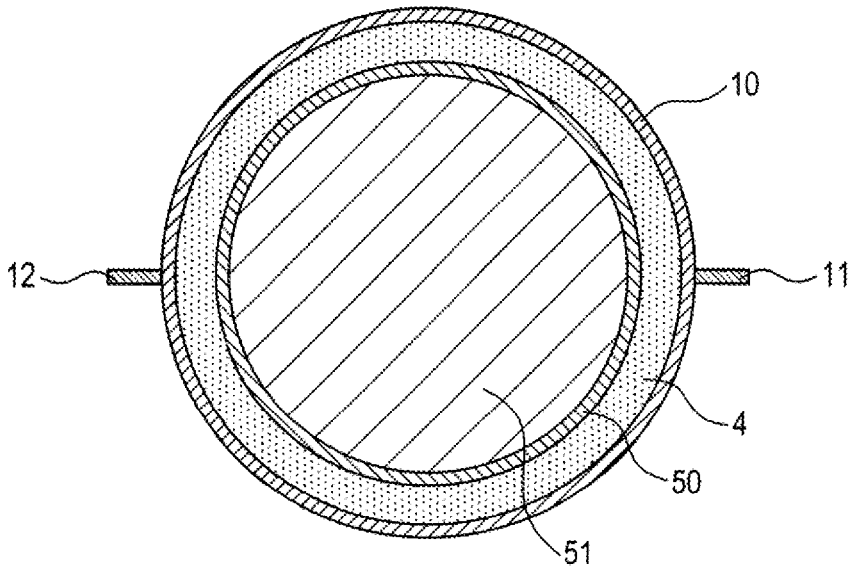
FIG. 2 is a schematic sectional view of the insulator cut along the line II-II.

As shown in FIGS. 1 and 2, the insulator 1 comprises a main body 10, swaged flanges 11 to 16, and a mat 4.

Each of the swaged flanges 11 to 16 includes, as mentioned below, at least one swaged portion 95 that is formed by compression pressing. Further, the insulator 1 is manufactured by coupling a first covering member 2 and a second covering member 3 to form the swaged portions 95. Each of the first and second covering members 2 and 3 includes a groove-shape. The first and second covering members 2 and 3 are coupled to each other to form the swaged portions 95, thereby manufacturing the insulator 1. Here, FIG. 1 shows the swaged portions 95 only in respect of its position.

The main body 10 includes a tubular body to cover a side surface of the exhaust member 5. The main body 10 extends in a downstream direction of the exhausted air along the exhaust member 5 and separates an inner side of the insulator 1 from an outer side of the insulator 1.

Each of the swaged flanges 11 to 16 is a wall-like portion that protrudes from a side surface of the main body 10. Here, such swaged flanges may be one or plural in number and are not limited to six in number.

The mat 4 fills a space between the main body 10 and the exhaust member 5. The mat 4 is arranged to cover an inner side of the body 10 and the side surface of the exhaust member 5. Therefore, the main body 10 is supported from inside via the mat 4. The mat 4 has a cushioning property and a heat-insulating property and therefore absorbs at least one of the vibration or the noise from the exhaust member 5. Further, in one example, the mat 4 may be made of an alumina fiber, glass-wool, or the like.

[1-2. Respective Configurations of First and Second Covering Members]

As shown in FIGS. 3 to 14, the insulator 1 is manufactured by coupling the first covering member 2 to the second covering member 3 by swaging. In one example, the first covering member 2 and the second covering member 3 both are made of stainless-steel, aluminum, or the like, and include a plate-shape.

The first covering member 2 includes a groove 20 and flanges 21 to 26 (specifically, flanges 21, 23, and 25 and perforated flanges 22, 24, and 26).

The groove 20 is a groove-like portion that separates the inner side of the insulator 1 from the outer side of the insulator 1 and forms the main body 10. Further, an inner side of the groove 20 is covered with a lower mat 40, which is a part of the above-described mat 4.

Each of the flanges 21 to 26 protrudes outward of the groove 20 from a rim on the side of the groove 20 (hereinafter, referred to as a "side rim") and extends along the groove 20.

The perforated flanges 22, 24, and 26, respectively, include insertion holes 22*a*, 24*a*, and 26*a*. Each of the insertion holes 22*a*, 24*a*, and 26*a* is substantially circular to have the inner diameter that substantially corresponds to the outer diameter of a pin 70*a* mentioned below.

The second covering member 3 is formed similarly to the first covering member 2. In other words, as with the first covering member 2, the second covering member 3 includes a groove 30 and flanges 31 to 36 (specifically, flanges 31, 33, and 35 and perforated flanges 32, 34, and 36). As with the first covering member 2, an inner side of the groove 30 of the second covering member 3 is covered with an upper mat 41, which is a part of the above-described mat 4.

The flanges 31 to 36 of the second covering member 3 correspond to the flanges 21 to 26 of the first covering member 2, respectively, to make a set of two. Hereinafter, the set of two is also referred to as a flange set. Further, the perforated flanges 32, 34, and 36 of the second covering member 3, respectively, include insertion holes 32*a*, 34*a*, and 36*a*. The perforated flanges 32, 34, and 36 including the insertion holes 32*a*, 34*a*, and 36*a* correspond to the perforated flanges 22, 24, and 26 including the insertion holes 22*a*, 24*a*, and 26*a*, respectively, to make respective flange sets. The insertion holes 22*a*, 24*a*, and 26*a* of the first covering member 2 and the insertion holes 32*a*, 34*a*, and 36*a* of the second covering member 3 are formed to respectively match with each other in position and to communicate with each other when the first covering member 2 is assembled to the second covering member 3.

[1-3. Method of Manufacturing Insulator]

A description will be given to a method of manufacturing the insulator 1. The method can be read as a method of manufacturing the exhaust member 5 that comprises the insulator 1 and also as a method of mounting the insulator 1 over the exhaust member 5.

The method of manufacturing the insulator 1 comprises (1) a first supporting member placement process, (2) a first covering member placement process, (3) an exhaust member placement process, (4) a second covering member placement process, (5) a second supporting member placement process, (6) a swaging process, and (7) a releasing process. Hereinafter, a description is given to each process. The number of the first supporting member, the second supporting member, a first base, and a second base used in these processes is half the number of the flanges arranged in the first covering member 2 and the second covering member 3.

[(1) First Supporting Member Placement Process]

Figure 3:
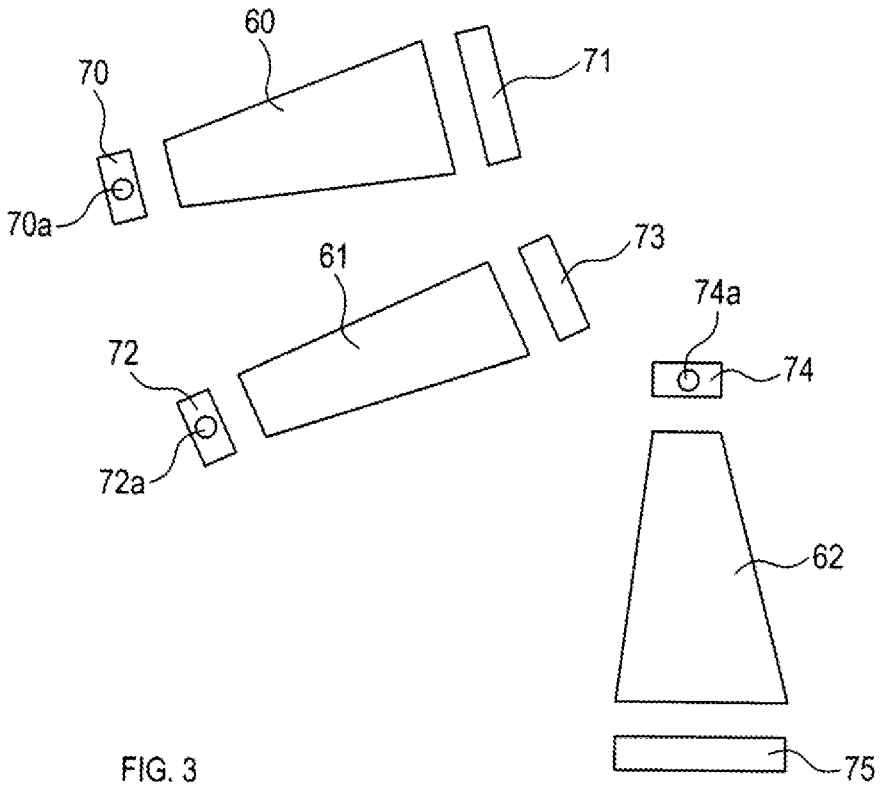
FIG. 3 is a schematic plan view of first supporting members, first bases, and second bases arranged in a first supporting member placement process.
Figure 4:
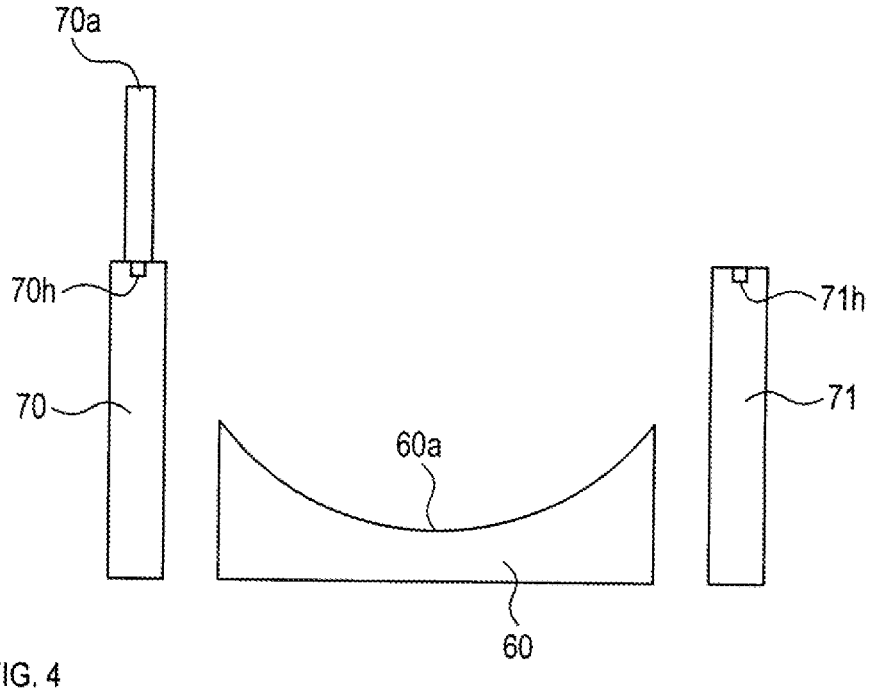
FIG. 4 is a schematic side view of one of the first supporting members, one of the first bases, and one of the second bases arranged in the first supporting member placement process.

As shown in FIG. 3, the first supporting member placement process places three first supporting members 60 to 62 and six bases 70 to 75. The six bases 70 to 75 includes three first bases 71, 73, and 75 and there second bases 70, 72, and 74. Each of the second bases 70, 72, and 74 includes at least one pin. Specifically, the second base 70 includes a cylindrical pin 70*a* that protrudes upward from a top surface of the second base 70. Similarly, the second base 72 includes a pin 72*a*; and the second base 74 includes a pin 74*a*. As shown in FIG. 4, the bases 70 to 75 include recessed portions 70*h* and 71*h*. The recessed portions 70*h* and 71*h* may be included in all the bases 70 to 75 or included in some of the bases 70 to 75.

The pins 70*a*, 72*a*, and 74*a* may be shaped into a square column or a plate, for example. Further, the pins 70*a*, 72*a*, and 74*a* move upward and downward, to thereby change a protruding distance from respective top surfaces of the second bases 70, 72, and 74, and are housed inside of the second bases 70, 72, and 74, respectively, in accordance with a downward movement.

The first supporting members 60 to 62 are configured to support an outer side of the groove 20 of the first covering member 2 from below. Each of the first supporting members 60 to 62 corresponds to a corresponding pair of the flange and the perforated flange of the first covering member 2 arranged opposite to each other across the groove 20 (hereinafter, referred to as a flange pair). Each of the first supporting members 60 to 62 supports the outer side of the groove 20 from below at an area (hereinafter, referred to as a support area) between the corresponding flange pair.

As shown in FIG. 4, the first supporting member 60 contacts the support area via a top surface 60*a* of the first supporting member 60 and supports the groove 20 from below. The top surface 60*a* is shaped to correspond to the support area. In one example, the top surface 60*a* is shaped into a circular arc when viewed laterally and is configured such that an entirety of the top surface 60*a* contacts the support area. Similarly, the first supporting members 61 and 62 contact respective support areas via respective top surfaces and support the groove 20 from below.

The first bases 71, 73, and 75 individually correspond to the flanges 21, 23, and 25 of the first covering member 2. In contrast, the second bases 70, 72, and 74 individually correspond to the perforated flanges 22, 24, and 26 of the first covering member 2. The first bases 71, 73, and 75 and the second bases 70, 72, and 74 each include a support surface that is configured to abut the corresponding flange, the support surface being included in an upper portion of each base. Each of the bases 70 to 75 supports the corresponding flange from below via the support surface.

[(2) First Covering Member Placement Process]

Figure 5:
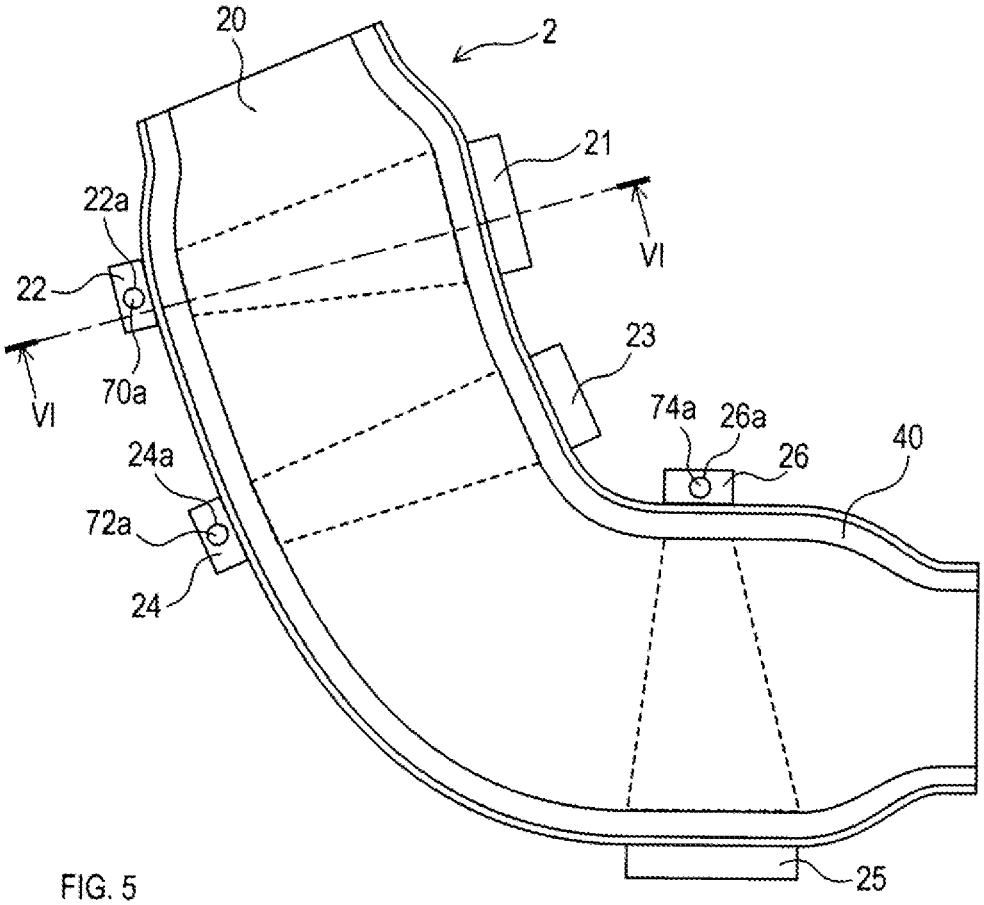
FIG. 5 is a schematic plan view of a first covering member and the like arranged in a first covering member placement process.
Figure 6:
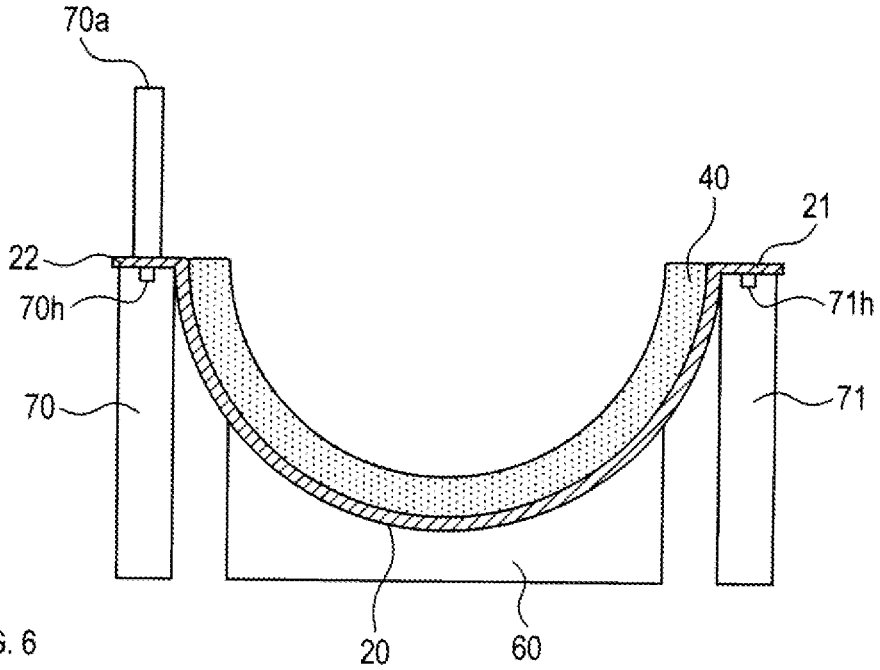
FIG. 6 is a schematic sectional view of the first covering member and the like taken along the line VI-VI, the first covering member and the like being arranged in the first covering member placement process.

The first covering member placement process is performed after the first supporting member placement process. As shown in FIGS. 5 and 6, the first covering member placement process places the first covering member 2 in a state where the following conditions (a) to (c) are fully satisfied.

(a) Each support area on the outer side of the groove 20 of the first covering member 2 is supported from below by the corresponding first supporting member.

(b) The perforated flanges 22, 24, and 26 of the first covering member 2 are individually supported from below by the second bases 70, 72, and 74. Additionally, these perforated flanges 22, 24, and 26 are individually fixed in position with respect to the second bases 70, 72, and 74. Specifically, this occurs as a result of the pins 70*a*, 72*a*, and 74*a* of the second bases 70, 72, and 74 being individually fitted into the insertion holes 22*a*, 24*a*, and 26*a*.

(c) The flanges 21, 23, and 25 of the first covering member 2 are individually supported from below by the first bases 71, 73, and 75.

[(3) Exhaust Member Placement Process]

Figure 7:
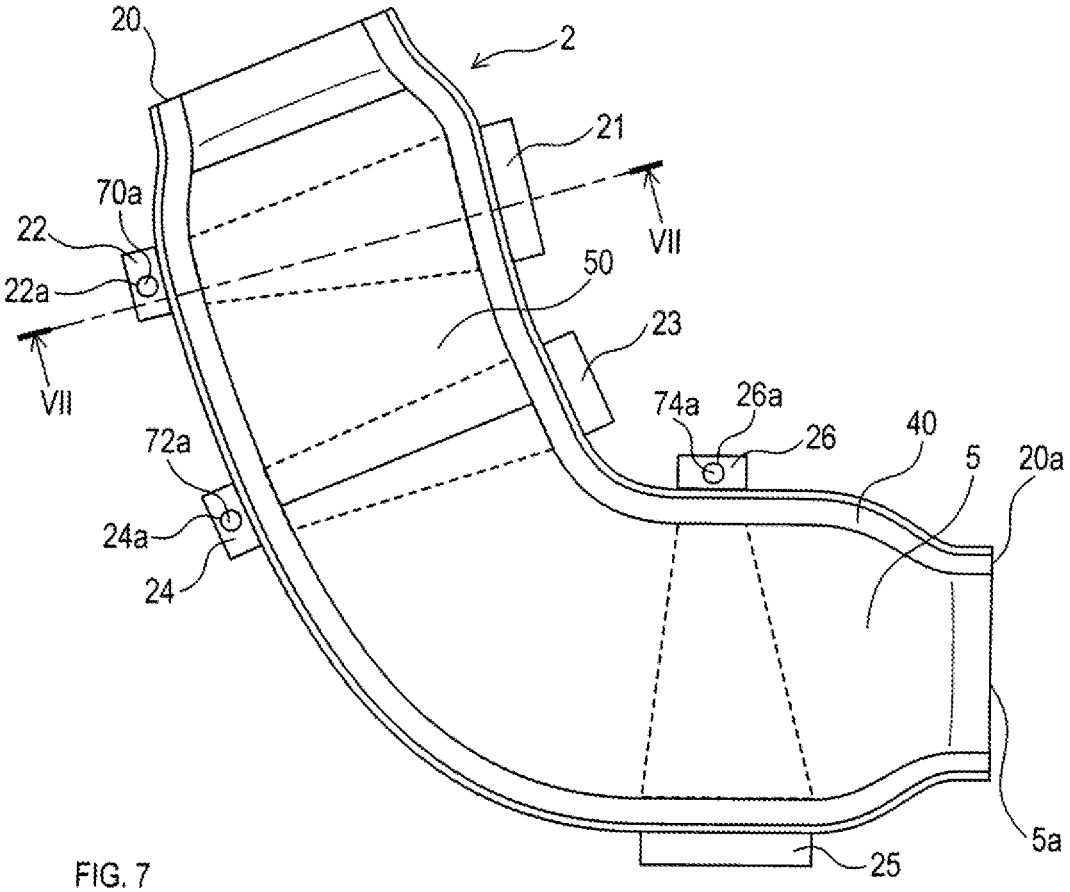
FIG. 7 is a schematic plan view of an exhaust member and the like arranged in an exhaust member placement process.
Figure 8:
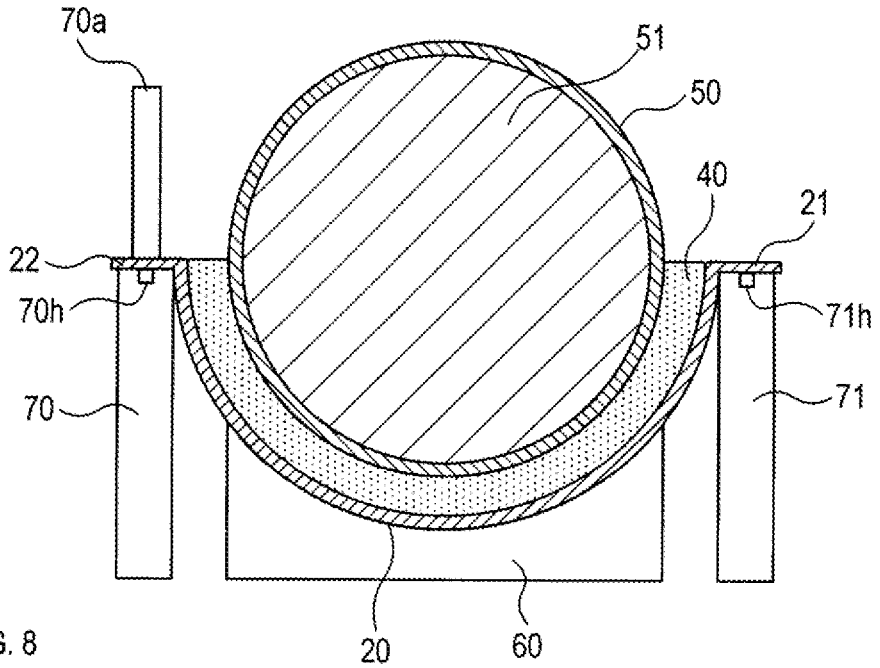
FIG. 8 is a schematic sectional view of the exhaust member and the like taken along the line VIII-VIII, the exhaust member and the like being arranged in the exhaust member placement process.

The exhaust member placement process is performed after the first covering member placement process. As shown in FIGS. 7 and 8, the exhaust member placement process places the exhaust member 5 inside of the groove 20 of the first covering member 2, which is disposed in the first covering member placement process. During the exhaust member placement process, the exhaust member 5 is disposed along the groove 20 so that the side surface of the exhaust member 5 abuts the lower mat 40 that covers the inner side of the groove 20. In one example, a position of the exhaust member 5 may be determined by matching a position of an end 20*a* of the groove 20 with a position of an end 5*a* of the exhaust member 5.

[(4) Second Covering Member Placement Process]

Figure 9:
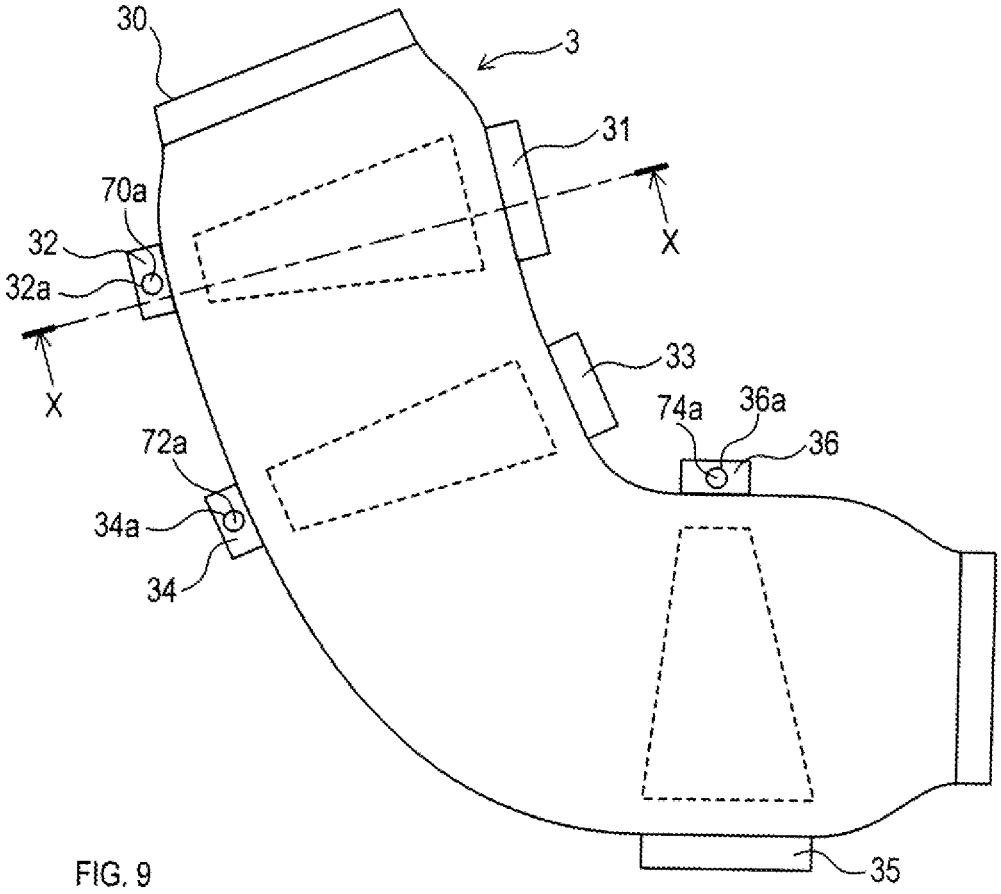
FIG. 9 is a schematic plan view of a second covering member and the like arranged in a second covering member placement process.
Figure 10:
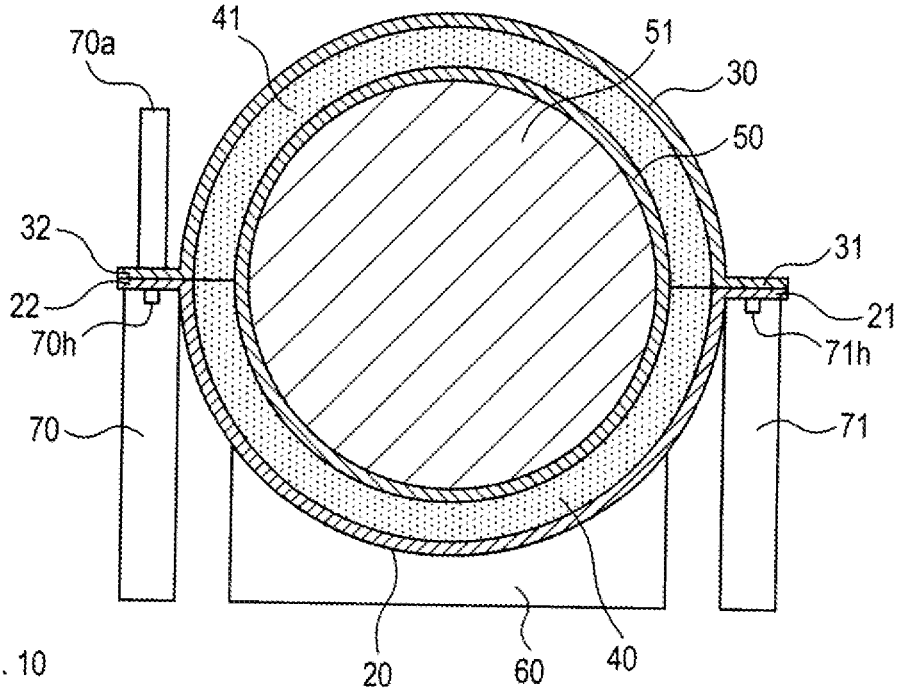
FIG. 10 is a schematic sectional view of the second covering member and the like taken along the line X-X, the second covering member and the like being arranged in the second covering member placement process.

The second covering member placement process is performed after the exhaust member placement process. As shown in FIGS. 9 and 10, the second covering member placement process places the second covering member 3 in a state where the following conditions (d) to (f) are fully satisfied.

(d) The inner side of the groove 30 of the second covering member 3 faces the exhaust member 5, which is disposed on the first covering member 2, and the inner side of the groove 20 of the first covering member 2 via the upper mat 41.

(e) The flanges 31, 33, and 35 of the second covering member 3 are individually supported from below by the first bases 71, 73, and 75 while abutting the respective flanges of the first covering member 2.

(f) The second covering member 3 is disposed on the first covering member 2 and the perforated flanges 32, 34, 36 of the second covering member 3 are individually supported from below by the second bases 70, 72, and 74 while abutting the respective perforated flanges of the first covering member 2. In addition, the perforated flanges 32, 34 and 36 are fixed in position as a result of the pins 70*a*, 72*a*, and 74*a* of the second bases 70, 72, and 74 being individually fitted into the insertion holes 22*a*, 24*a*, and 26*a*.

The exhaust member placement process brings the exhaust member 5 into placement along the groove 30 of the second covering member 3. Also, the side surface of the exhaust member 5 abuts the upper mat 41 that covers the inner side of the groove 30.

[(5) Second Supporting Member Placement Process]

Figure 11:
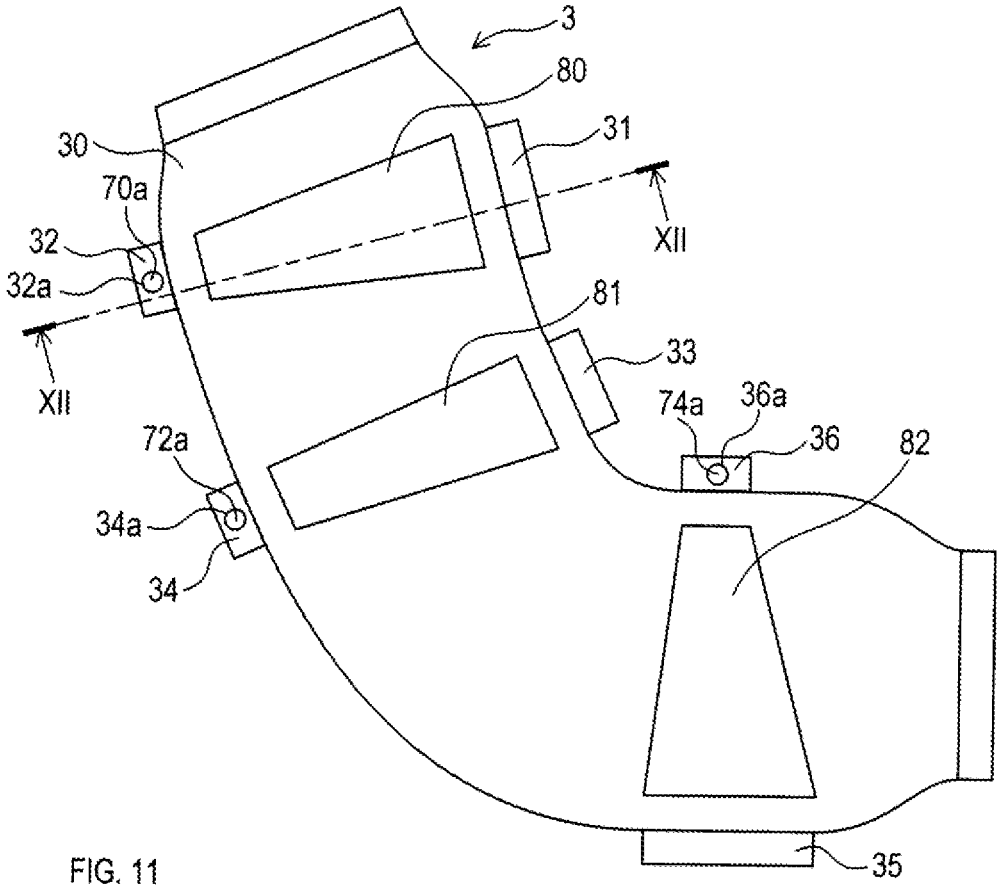
FIG. 11 is a schematic plan view of the second supporting member and the like arranged in a second supporting member placement process.
Figure 12:
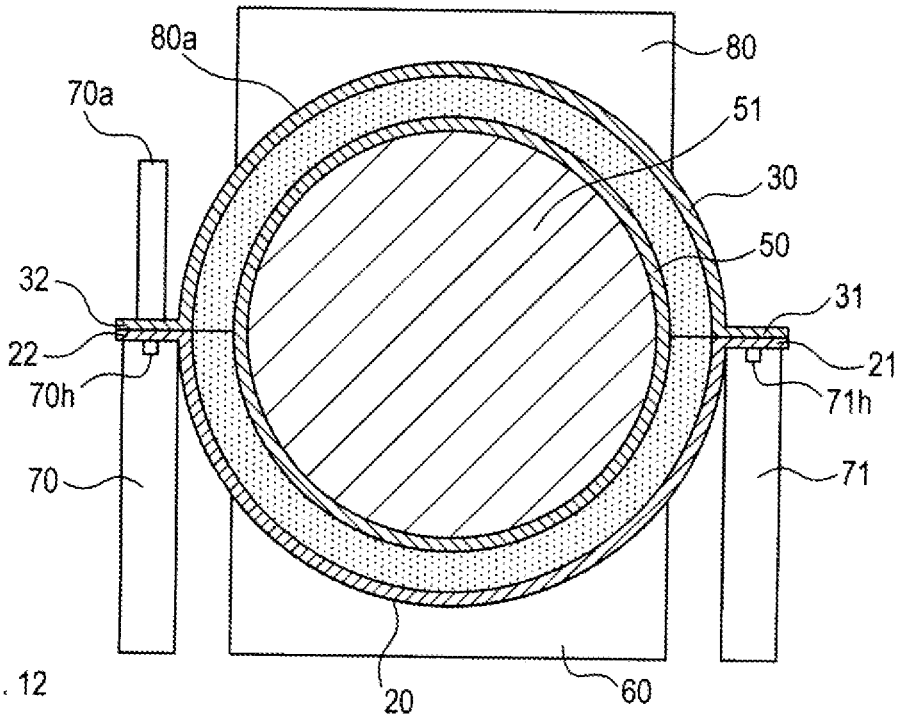
FIG. 12 is a schematic sectional view of the second supporting member and the like taken along the line XII-XII, the second supporting member and the like being arranged in the second supporting member placement process.

The second supporting member placement process is performed after the second covering member placement process. As shown in FIGS. 11 and 12, the second supporting member placement process places the second supporting members 80 to 82 such that these members cover, from above, the outer side of the groove 30 of the second covering member 3, which is disposed in the second covering member placement process.

The second supporting members 80 to 82 are configured to press the outer side of the groove 30 of the second covering member 3 from above. Each of the second supporting members 80 to 82 corresponds to a corresponding pair of the flange and the perforated flange of the second covering member 3 arranged opposite to each other across the groove 30 (flange pair). Each of the second supporting members 80 to 82 presses the outer side of the groove 30 from above at an area (hereinafter, referred to as a press area) between the corresponding flange pair.

As shown in FIG. 11, the second supporting member 80 contacts the press area via a bottom surface 80*a* of the second supporting member 80 and presses the groove 30 from above. The bottom surface 80*a* is shaped to correspond to the press area. In the present embodiment, as one example, the bottom surface 80*a* is shaped into a circular arc when viewed laterally and is configured such that an entirety of the bottom surface 80*a* contacts the press area. Similarly, the second supporting members 81 and 82 contact the respective press areas via respective bottom surfaces and press the groove 30 from above.

Accordingly, the second supporting members 80 to 82 individually face the first supporting members 60 to 62. In other words, the first covering member 2 and the second covering member 3 are vertically interposed between the first and second supporting members at the support areas and the press areas.

[(6) Swaging Process]

The swaging process is performed after the second supporting member placement process in a state where the pin 70*a* is inserted through the second covering member 3 and the first covering member 2 and the first covering member 2 and the second covering member 3 are kept vertically interposed between the first and second supporting members at the support areas and the press areas. In the swaging process, at least the perforated flanges 22, 24, and 26 of the first covering member 2, which include the insertion holes 22*a*, 24*a*, and 26*a*, are swaged with the perforated flanges 32, 34, and 36 of the second covering member 3, which include the insertion holes 32*a*, 34*a*, and 36*a* and abut the perforated flanges 22, 24, and 26, to thereby form the swaged portions 95. In the present embodiment, however, the flanges 21, 23, and 25 and 31, 33, and 35 that do not include the insertion holes are also swaged similarly to form the swaged portions 95.

The swaging of the present embodiment, in particular, involves performing of the compression pressing that reduces a plate thickness of each of the flanges 21 to 26 of the first covering member 2 and a plate thickness of each of the flanges 31 to 36 of the second covering member 3.

Figure 13:
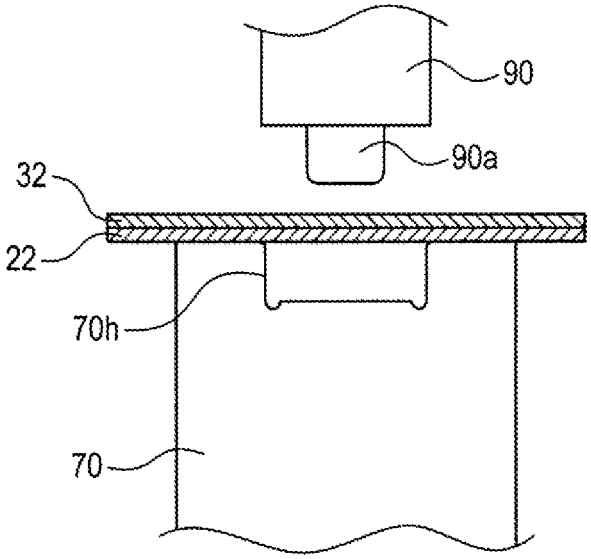
FIG. 13 is an explanatory diagram of a swaging process.

More specifically, the swaging process performs the following compression pressing. As shown in FIGS. 12 and 13, the bases 70 to 75 individually include the recessed portions 70*h* and 71*h*, each including a recess bottom. Specifically, the recessed bottom is surrounded by a side surface of the recessed portion along an entire circumference of the recess bottom. An upper end of the side surface abuts the first covering member 2. Further, there is provided a punch body 90 that includes a punch portion 90*a*. The punch portion 90*a* is smaller in circumference than the recessed portions 70*h* and 71*h* are.

In the swaging, the punch body 90 descends downward to thereby perform the compression pressing in which the punch portion 90*a* pushes the flanges 21 to 26 of the first covering member 2 and the flanges 31 to 36 of the second covering member 3 into the individual recessed portions 70*h* and 71*h*.

Such a configuration enables arrangement of the recessed portions 70*h* and 71*h* formed such that the respective recess bottoms are circumferentially surrounded by the bases 70 to 75; and performs pressing toward an inner side than the side surface of each recessed portion is. As a result, the recessed portions 70*h* and 71*h* bear a large portion of a reaction force caused by a pressing force when the flanges 21 to 26 and 31 to 36 are pressed and thus deformed. Accordingly, it is possible to inhibit occurrence, in which deformation of the flanges 21 to 26 and 31 to 36 influences outward of the recessed portions 70*h* and 71*h*. Therefore, even the 70*a*, 72*a*, and 74*a* inserted through the perforated flanges 22, 24, and 26 and 32, 34, and 26 to be swaged can be inhibited from being individually caught in the insertion holes 22*a*, 24*a*, and 26*a* and 32*a*, 34*a*, and 36*a* during release of the pins 70*a*, 72*a*, and 74*a* in a below-mentioned releasing process. Consequently, it is possible to favorably swage the respective flange sets of the perforated flanges 22, 24, and 26 and 32, 34, and 36 through which the pins 70*a*, 72*a*, and 74*a* are individually inserted.

Figure 14:
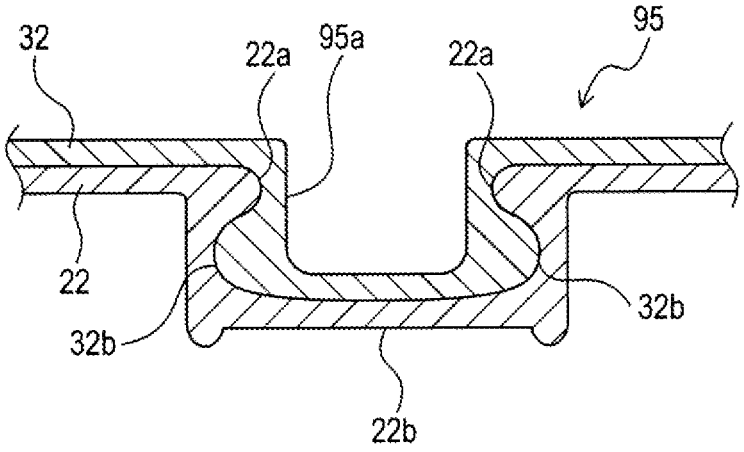
FIG. 14 is a central sectional view of a swaged portion.

As shown in FIG. 14, the above-described swaging forms a punch hole 95*a* in each swaged portion 95 by the pressing. Also, the flanges 21 to 26 of the first covering member 2 and the flanges 31 to 36 of the second covering member 3 penetrate into each other. For example, the perforated flange 22 of the first covering member 2 is coupled to the perforated flange 32 of the second covering member 3. In this case, a part of the perforated flange 32 of the second covering member 3 squeezes into the perforated flange 22 of the first covering member 2, to thereby forms a protruded portion 32*b*.

In contrast, a part of the perforated flange 22 of the first covering member 2 forms a bending portion 22*a*. The bending portion 22*a* is located on substantially the same plane as the perforated flange 22 of the first covering member 2 before the swaging. Further, the bending portion 22*a* is an end located closer to the punch hole 95*a* in the part of the perforated flange 22, the end squeezing into the perforated flange 32 of the second covering member 3. The bending portion 22*a* and a bottom portion 22*b* of the perforated flange 22 of the first covering member 2 together hold and retain the protruded portion 32*b*.

Here, the flanges 21 to 26 of the first covering member 2 and the flanges 31 to 36 of the second covering member 3 penetrate into each other. This means that the protruded portion 32*b* is positioned farther from the punch hole 95*a* than the bending portion 22*a* is in a direction perpendicular to an operational direction of the punch body 90.

This configuration enables the protruded portion 32*b* to be caught to the bending portion 22*a* before the first covering member 2 and the second covering member 3 are separated from each other. Therefore, it is possible to easily keep the first covering member 2 coupled to the second covering member 3.

[(7) Releasing Process]

The releasing process is performed after the swaging process. The releasing process releases positional fixation of the swaged flanges 11 to 16 of the first and second covering members 2 and 3. In one example, the pins 70*a*, 72*a*, and 74*a*, respectively, are housed in the second bases 70, 72, and 74. As a result, the pins 70*a*, 72*a*, and 74*a* are individually released from the insertion holes 22*a*, 24*a*, and 26*a* and 32*a*, 34*a*, and 36*a* of the respective perforated flanges, thus releasing the positional fixation. In another example, the pins 70*a*, 72*a*, and 74*a* may be individually removed upward from the insertion holes 22*a*, 24*a*, and 26*a* and 32*a*, 34*a*, and 36*a* of the respective perforated flanges, thus releasing the positional fixation.

[1-3. Effects]

The embodiment detailed above provides the following effects.

(1a) In one aspect, the insulator 1 of the present embodiment is the tubular member covering the exhaust member 5 that causes the exhausted air from the internal combustion engine of the vehicle to flow downstream. The insulator 1 is formed by assembling the first covering member 2 and the second covering member 3 to each other, both having the plate-shape. In the insulator 1, the first covering member 2 includes the groove 20, the flanges 21, 23, and 25, and the perforated flanges 22, 24, and 26; and the second covering member 3 includes the groove 30, the flanges 31, 33, and 35, and the perforated flanges 32, 34, and 36.

The grooves 20 and 30 separate the inner side of the insulator 1 from the outer side of the insulator 1 and each include the groove-like portion. The flanges 21 to 26 and 31 to 36, respectively, protrude outward of the grooves 20 and 30 from the respective side rims thereof. At least one of the perforated flanges 22, 24, and 26 of the first covering member 2 includes the corresponding insertion holes 22*a*, 24*a*, or 26*a* through which the pin 70*a* is inserted. At least one of the perforated flanges 32, 34, and 36 of the second covering member 3 incudes the corresponding insertion holes 32*a*, 34*a*, or 36*a* through which the pin 70*a* is inserted. The insulator 1 is assembled such that the insertion holes 22*a*, 24*a*, and 26*a* of the perforated flanges 22, 24, and 26 of the first covering member 2 communicate with the insertion holes 32*a*, 34*a*, and 36*a* of the perforated flanges 32, 34, and 36 of the second covering member 3, respectively. Further, the perforated flanges 22, 24, and 26 and the perforated flanges 32, 34, and 36 with the insertion holes 22*a*, 24*a*, and 26*a* and 32*a*, 34*a*, and 36*a*, respectively, include the swaged portions 95. The swaged portions 95 are formed as a result of the flanges 21 to 26 of the first covering member 2 and the flanges 31 to 36 of the second covering member 3 penetrating into each other, respectively, by the pressing.

Such a configuration enables the flanges 21 to 26 of the first covering member 2 to be swaged with the flanges 31 to 36 of the second covering member 3 while the pin 70*a* is inserted through the corresponding flange set of the perforated flanges of the first and second covering members 2 and 3, to thereby form the swaged portions 95 in which the flanges 21 to 26 and the flanges 31 to 36 penetrate into each other by the pressing. According to this configuration, the pin 70*a* is located proximally to a portion to be swaged. Therefore, the insulator 1 can be favorably manufactured even if the first covering member 2 and the second covering member 3 are easily deformed. Additionally, in the swaged portions 95, the flanges 21 to 26 of the first covering member 2 and the flanges 31 to 36 of the second covering member 3 penetrate into each other, respectively, by the pressing. This enables the flanges 21 to 26 of the first covering member 2 and the flanges 31 to 36 of the second covering member 3 to be firmly fixed to each other, respectively.

(1b) In one aspect of the present disclosure, the method of manufacturing the insulator 1 enables the outer side of the groove 20 of the first covering member 2 to be supported from below by at least one of the first supporting members 60 to 62. Also, the flanges 21 to 26 of the first covering member 2 are individually supported by the bases 70 to 75 from below. Further, the first covering member 2 is disposed such that the pin 70*a* retained on the second base 70 is inserted through the corresponding insertion holes 22*a*, 24*a*, or 26*a* of the first covering member 2, so that the first covering member 2 is fixed in position.

According to the method of manufacturing the insulator 1, the second covering member 3 is disposed on the first covering member 2 such that the inner side of the groove 30 of the second covering member 3 faces the inner side of the groove 20 of the first covering member 2; the flanges 31 to 36 of the second covering member 3, respectively, are placed on the flanges 21 to 26 of the first covering member 2; and the pin 70*a* retained on the second base 70 is inserted through the corresponding insertion holes 32*a*, 34*a*, or 36*a* of the second covering member 3, so that the second covering member 3 is fixed in position.

In the method of manufacturing the insulator 1, the supporting member 80, which is at least one in number, is disposed so as to cover the outer side of the groove 30 of the second covering member 3 from above. Also, in the method of manufacturing the insulator 1, at least the perforated flanges 22, 24, and 26 of the first covering member 2 with the insertion holes 22*a*, 24*a*, and 26*a* are swaged with the perforated flanges 32, 34, and 36 of the second covering member 3, which include the insertion holes 32*a*, 34*a*, and 36*a* and abut the perforated flanges 22, 24, and 26, while the pin 70*a* is inserted through the corresponding flange set of the perforated flanges of the first and second covering members 2 and 3.

This manufacturing method enables the flanges 21 to 26, respectively, to be swaged with the flanges 31 to 36, with the pin 70*a* being inserted through the corresponding flange set. It is therefore possible to inhibit the first covering member 2 and the second covering member 3 from being displaced in comparison with a configuration in which the pin 70*a* and the portion to be swaged are arranged in different flanges. As a result, the insulator 1 can be favorably manufactured even if the first covering member 2 and the second covering member 3 are easily deformed.

(1c) In one aspect of the present disclosure, the swaging is performed by the compression pressing in which the flanges 21 to 26 of the first covering member 2 and the flanges 31 to 36 of the second covering member 3 are reduced in plate thickness.

This manufacturing method applies, as the swaging, the compression pressing to decrease the plate thickness and therefore, it is possible to both reduce a swaging point in size and to firmly couple the flanges 21 to 26, respectively, to the flanges 31 to 36.

(1d) In one aspect of the present disclosure, the bases 70 to 75 individually include the recessed portions 70*h* and 71*h*, each including the recess bottom circumferentially surrounded by the side surface that abuts, in the upper end thereof, the first covering member 2. In the swaging, the punch portion 90*a* performs the compression pressing in which the flange portions 21 to 26 of the first covering member 2 and the flange portions 31 to 36 of the second covering member 3 are individually pressed into the recessed portions 70*h* and 71*h*. Here, the punch 90*a* is smaller in circumference than the recessed portions 70*h* and 71*h* are.

According to this manufacturing method, the punch portion 90*a* performs the compression pressing as the swaging to individually press the flanges 21 to 26 and 31 to 36 into the recessed portions 70*h* and 71*h*. This enables the flanges 21 to 26 and 31 to 36 to penetrate into each other. As a result, it is possible to firmly couple the flange 21 to 26, respectively, to the flanges 31 to 36.

[2. Other Embodiments]

Accordingly, the embodiment of the present disclosure has been described. However, the present disclosure is not limited to the above-described embodiment but can be variously modified.

Figure 15:
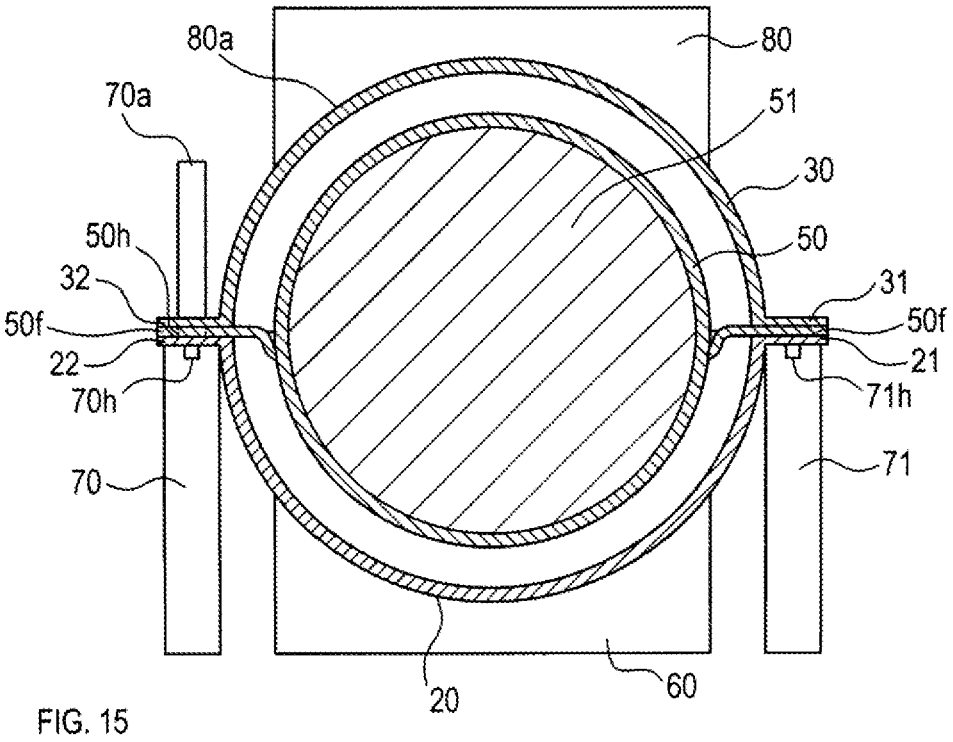
FIG. 15 is a schematic sectional view of the second supporting member and the like arranged in the second supporting member placement process in another embodiment.

(2a) In the above-described embodiment, the insulator 1 comprises the mat 4. However, the present disclosure is not limited hereto. Specifically, the insulator 1 may not comprise the mat 4.

Where the insulator 1 does not comprise the mat 4, the exhaust member 5 comprises an exhaust flange 50*f* as shown in FIG. 15. The exhaust flange 50*f* is a portion that protrudes outward from an outer circumference of the convertor 50. The exhaust flange 50*f* includes an insertion hole 50*h* to allow insertion of the pin 70*a* therethrough.

In addition, in the above-described "(3) Exhaust Member Placement Process", it is preferable to place the convertor 50 on the first covering member 2 such that the pin 70*a* retained on the base 70 is inserted through the insertion hole 50*h* of the exhaust flange 50*f*, so that the convertor 50 is fixed in position.

In this case, the exhaust flange 50*f* of the convertor 50 is placed on the flanges 21 to 26 of the first covering member 2.

Then, as in the aforementioned embodiment, the (4) second covering member placement process, the (5) second supporting member placement process, the (6) swaging process, and the (7) releasing process are performed. The (6) swaging process performs the swaging so as to include the exhaust flange 50*f* in addition to the first and second covering members 2 and 3 in the swaged portions 95.

This manufacturing method performs the swaging with the pin 70*a* being inserted through the insertion hole 50*h* that is included in the exhaust flange 50*f*. As a result, it is possible to simultaneously fix the convertor 50 to the second covering member 3 and to the first covering member 2 when they are fixed to each other.

Two or more functions achieved by one element in the aforementioned embodiment may be achieved by two or more elements; and one function achieved by one element in the aforementioned embodiment may be achieved by two or more elements. Two or more functions achieved by two or more elements in the aforementioned embodiment may be achieved by one element; one function achieved by two or more elements may be achieved by one element. A part of the configuration of the aforementioned embodiment may be omitted. At least a part of the configuration of the aforementioned embodiment may be added to or replaced with other configurations of the aforementioned embodiment. It should be noted that any and all modes that are encompassed in the technical ideas defined by the languages in the scope of the claims are embodiments of the present disclosure.

EXPLANATION OF REFERENCE NUMERAL

1 . . . insulator, 2 . . . first covering member, 3 . . . second covering member, 4 . . . mat, 5 . . . exhaust member, 5*a*. . . end, 10 . . . main body, 11 to 16 . . . swaged flange, 21 to 26, 31 to 36 . . . flange, 20 . . . groove, 22*a* to 26*a*, 32*a* to 36*a* . . . insertion hole, 22*a* . . . bending portion, 22*b* . . . bottom portion, 30 . . . groove, 32*b* . . . protruded portion, 40 . . . lower mat, 41 . . . upper mat, 50 . . . converter, 50*f* . . . exhaust flange portion, 50*h* . . . insertion hole, 51 . . . catalyst, 60 to 62 . . . first supporting member, 70 to 75 . . . base, 70*a*, 72*a*, 74*a*. . . pin, 80 to 82 . . . second supporting member, 90 . . . punch body, 90*a*. . . punch portion, 95 . . . swaged portion, 95*a*. . . punch hole

What is claimed is:

1. A method of manufacturing an insulator from a first covering member and a second covering member, the method comprising:

disposing the first covering member;

disposing the second covering member on the first covering member; and swaging the first covering member with the second covering member, wherein the insulator comprises a tubular shape to cover an exhaust member that causes exhausted air from an internal combustion engine of a vehicle to flow downstream, wherein the first covering member and the second covering member each include a plate-shape;

wherein the first covering member and the second covering member each include:

a groove separating an inner side of the insulator from an outer side of the insulator; and flanges protruding outward from a side rim of the groove, the flanges including a perforated flange that includes an insertion hole to allow insertion of a pin therethrough, wherein the first covering member is disposed such that:

an outer side of the groove of the first covering member is supported by a first supporting member from below;

each of the flanges of the first covering member is supported by a base from below;

the pin, which is retained on the base, is inserted through the insertion hole of the perforated flange of the first covering member; and the first covering member is thereby fixed in position, wherein the second covering member is disposed on the first covering member such that:

an inner side of the groove of the second covering member faces an inner side of the groove of the first covering member;

the flanges of the second covering member are individually placed on the flanges of the first covering member;

the pin retained on the base is inserted through the insertion hole of the perforated flange of the second covering member; and the second covering member is thereby fixed in position, wherein the method further comprises disposing a second supporting member to cover an outer side of the groove of the second covering member from above, wherein the swaging is performed such that at least the perforated flange of the first covering member including the insertion hole is swaged with the perforated flange of the second covering member including the insertion hole as the pin is inserted through the first covering member and the second covering member, and wherein the perforated flange of the second covering member abuts the perforated flange of the first covering member.

2. The method of manufacturing the insulator according to claim 1, wherein the swaging is performed by compression pressing that decreases respective plate thicknesses of the perforated flange of the first covering member and the perforated flange of the second covering member.

3. The method of manufacturing the insulator according to claim 1, wherein the base includes a recessed portion including a recess bottom that is surrounded by a side surface of the recessed portion, the side surface having an upper end that abuts the first covering member, and wherein, in the swaging, a punch portion performs the compression pressing to press the perforated flange of the first covering member and the perforated flange of the second covering member into the recessed portion, and wherein the punch portion is smaller in circumference than the recessed portion is.

4. The method of manufacturing the insulator according to claim 1, wherein the exhaust member is disposed on the first covering member such that:

the first covering member is disposed on the base;

an exhaust flange is then brought into placement on the flanges of the first covering member before disposal of the second covering member on the first covering member, the exhaust flange protruding outward from an outer circumference of the exhaust member and including an insertion hole to allow insertion of the pin therethrough;

the pin retained on the base is inserted through the insertion hole of the exhaust flange; and the exhaust member is thereby fixed in position.

* * * * *